United States Patent [19]

Watson

[11] 4,401,883

[45] Aug. 30, 1983

[54] ELECTRIC RESISTANCE HEATER

[75] Inventor: Robert A. Watson, Woodbury, Conn.

[73] Assignee: The Kanthal Corporation, Bethel, Conn.

[21] Appl. No.: 292,444

[22] Filed: Aug. 14, 1981

[51] Int. Cl.[3] ..... H05B 3/02

[52] U.S. Cl. ..... 219/381; 219/375; 219/536; 219/546; 219/552; 338/296; 338/316

[58] Field of Search ..... 219/304, 307, 369, 373, 219/375, 381, 523, 536, 537, 546, 552; 338/296, 298, 302, 304, 316, 333

[56] References Cited

U.S. PATENT DOCUMENTS

| | | | |
|---|---|---|---|
| 638,236 | 12/1899 | Gold | 338/296 X |
| 1,167,749 | 1/1916 | Hadaway, Jr. | 338/296 X |
| 1,171,059 | 2/1916 | Loguin | 338/296 X |
| 1,203,810 | 11/1916 | Tatum | 338/296 X |
| 1,715,018 | 5/1929 | Von Brockdorff | 338/316 X |
| 2,769,074 | 10/1956 | Dyckerhoff | 338/316 X |
| 2,973,498 | 2/1961 | Calvert | 338/296 |
| 3,551,643 | 12/1970 | Pricenski et al. | 219/381 |
| 4,207,457 | 6/1980 | Haglund et al. | 219/546 X |

*Primary Examiner*—Volodymyr Y. Mayewsky
*Attorney, Agent, or Firm*—Kenyon & Kenyon

[57] ABSTRACT

A horizontal porcupine coil of electric resistance heating wire is supported against sagging by two superimposed coil-center ceramic tubes containing a conductor for one end of the coil. If one tube cracks it is improbable that the other would crack in the same place, and this keeps to a minimum the possibility of short-circuiting between the conductor and coil.

4 Claims, 2 Drawing Figures

ELECTRIC RESISTANCE HEATER

BACKGROUND OF THE INVENTION

For heating uniformity, aluminum heat-treating furnaces rely on convection heating provided by air moved in large volumes and high velocities through the heat-treating chamber containing the aluminum parts under treatment. The air must be heated to temperatures adequately high to provide the required metallurgical results.

Such a furnace has at least one baffeled plenum through which at least one blower forces air at velocities of up to 100 mph, and the plenum contains at least one electric resistance heater.

To provide the necessary heat such a heater typically may have a length in the area of three feet and must support a resistance coil element consuming power in the area of 15,000 to 30,000 watts. For good efficiency the coil should expose as much of its surface to the air as is consistant with structural stability when stressed by the force of the air blast.

The maximum amount of heat exchange surface is provided when an electric resistance heating wire is coiled in the form of a porcupine coil such as was apparently first proposed by Loguin in his U.S. Pat. No. 1,171,059.

However, insofar as is known the porcupine coil configuration has never been used for a metallurgical convection heat-treating furnace where the necessary size of the coil, both as to wire gauge and length, presents problems concerning the mounting of the coil. The use of a porcupine coil has been suggested by the prior art for use in comparatively low-voltage hot-blast guns as evidenced by the Pricenski et al U.S. Pat. Nos. 3,551,643 and the Haglund patent 4,207,457.

The main object of the present invention is to provide an electric resistance heater capable of enjoying the advantages of the porcupine coil configuration and adapted for commercial use in such a metallurgical convection heat-treatment furnace, for example, where the heater must use heavy gauge resistance wire with a coil length in the the area of three feet or more and mounted so as to be stable and long-lived under the high blast velocities incidental to such service. In such an installation the heater must operate horizontally and transversely with respect to the air blast.

SUMMARY OF THE INVENTION

Basically the electric resistance heater of the present invention comprises the necessary elongated coil of resistance wire, particularly when in the form of a porcupine coil. A first rigid non-conductive refractory tube extends through the coil's open coil center so as to support the coil from sagging when horizontally positioned. Terminals are positioned at only one end of the tube, for the opposite ends of the coil, so that the heater can extend horizontally through the air blast plenum with that one end adapted to be fixed to the furnace wall with the terminals projecting through the wall for external power line connection. Other installations also require that both terminals be at only one end of the heater. An electric conductor extends through this tube and one of the coil's ends is connected directly dwith one of the terminals, the other end of the coil being connected, at the other or inner end of the tube, with the conductor, the latter extending backwardly through the tube and connecting with the other of the terminals.

Any suitable refractory tube is necessarily made of ceramic material and must support the porcupine coil when used, via the straight legs of the convolution loops, resulting in what are in effect point contacts between the coil and the tube. This subjects the tube to high thermal and mechanical stressing localized at the point contacts, and being necessarily ceramic tube, is subject to cracking which at the voltages required can cause a short-circuit between the coil and the conductor on the inside of the tube. This possibility and its suggestion of short service life under commercial operating conditions, has eliminated the porcupine coil from consideration concerning heavy duty applications.

The heater of the present invention uses a second rigid non-conductive refractory tube encircling the conductor inside of the first tube and again for practical reasons this second tube must be made of ceramic material and also capable of cracking when stressed. However, it has been found that even if both of the refractory tubes should crack, a short-circuit between the coil and the conductor cannot occur unless both tubes crack at the same place or, in other words, so that the cracks in the tubes radially register with each other. The odds against this occurring are so great as to be convincing that the service life of this new heater will be satisfactory even when using the porcupine coil form of element.

DESCRIPTION OF THE DRAWINGS

The accompanying drawings are for use in connection with the following detailed description of the presently preferred form of this invention, FIG. 1 being a longitudinal section and FIG. 2 a cross-section taken on the line II—II in FIG. 1.

DETAILED DESCRIPTION OF THE INVENTION

The porcupine coil 1 is shown with its helical series of substantially flat convolutions having the characteristic straight legs 1*a* defining an open coil center formed by the straight legs. To provide the heat output required for use in the described type of metallurgical heat-treating furnace the coil must be long and made of heavy gauge resistance wire as compared to prior art porcupine coil proposals. For example, the illustrated coil uses NO. 4 gauge wire having a 0.204 inch diameter, the coil is 35 inches long and the convolutions are bunched as closely together as is possible without the convolutions short-circuiting with each other. The coil is heat-treated so that the convolutions spacing is permanently set and does not require to be held under tension. The coil is designed for operation at 240 volts with a power consumption rating of 30,000 watts.

The coil is supported against sagging when in operation horizontally positioned, by the first rigid non-conductive refractory tube shown at 2 which is somewhat longer than the coil. This tube can be one of the commercially available refractory tubes made of fused alumina, possibly mixed with silica. There are different types of such commercially available tubes and the one chosen for this tube 2 is preferrably one of those recommended for its strength and maximum resistance to cracking at high temperatures, rather than for its electrical insulating properties at high temperatures.

Figure 1:
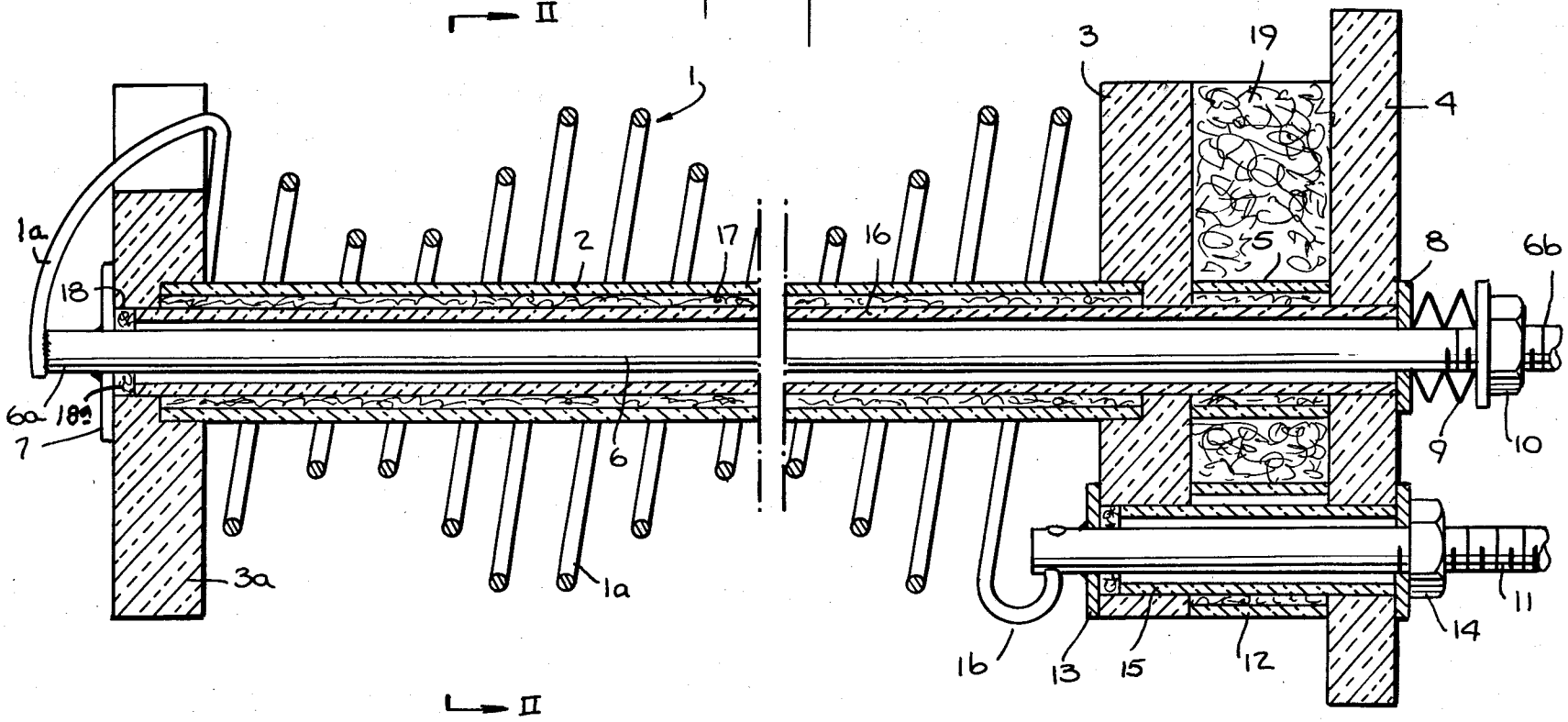
Figure 2:
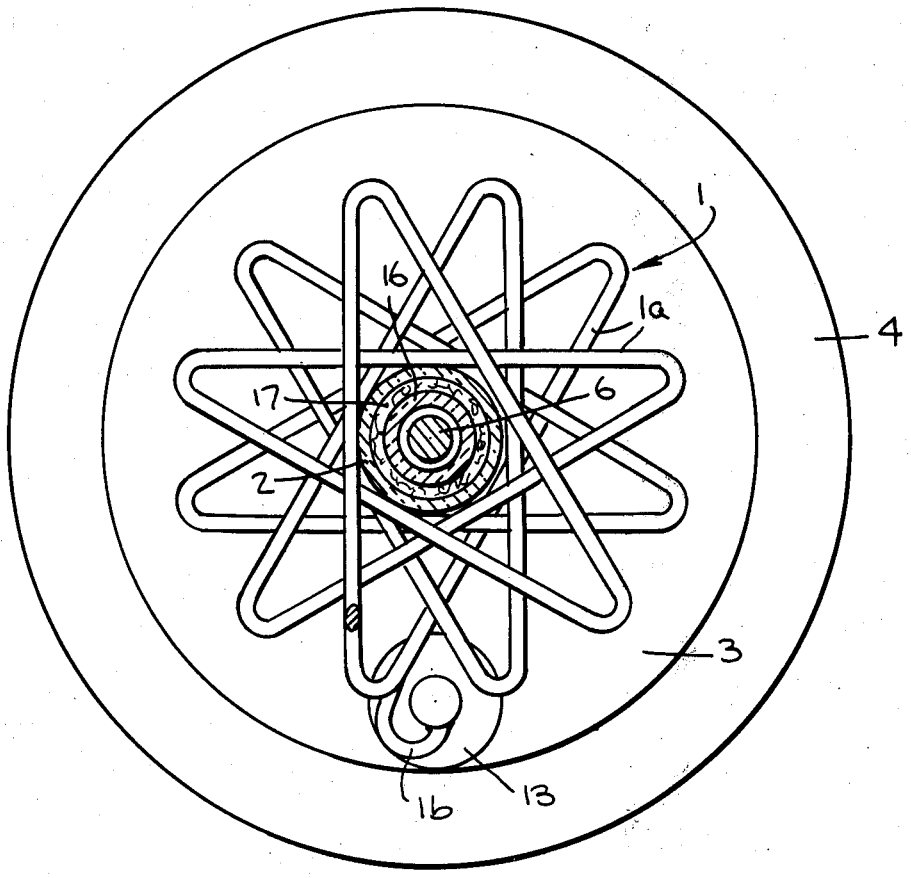

However, with any such tube cracking can occur because as can be seen from FIG. 2 the coil legs 1*a* tangentially contact the outside of the tube so as to form point contacts of maximum temperature and stress, keeping in mind that an air blast at 100 mph or more will flow transversely through and over the coil when the heater is operating in a metallurgical convection heating furnace.

The opposite ends of the tube 2 seat in the shoulders of counterbores formed in ceramic end caps 3 and 3*a* respectively and a furnace wall mounting flange 4, also ceramic, is held spaced a short distance from the end cap 3 by tubular ceramic spacers 5. To hold everything together the previously mentioned conductor 6 which extends from the left hand end cap 3*a* through the tube 2, end cap 3, spacer 5 and flange 4, at the left hand end engages the end cap 3*a* via a welded flange 7, and at the right hand end the conductor 6 via a washer 8 and compression spring 9, is held by a nut 10 which when screwed up places the conductor in elastic tension pulling the end caps 3 and 3*a* and the flange 4 together.

The left hand 6*a* end of the conductor 6 extends beyond the flange 7 and one end 1*a* of the coil is welded to this end of the conductor.

The right hand end 6*b* of the conductor 6 is threaded for the nut 10, and the end cap 3 and flange 4, at a radially spaced position, carries the second terminal 11 which is in the form of a short conductor arranged somewhat as described before, having a spacer 12 between the end cap 6 and flange 4, a welded-on flange 13 on its inner end and a nut 14 on its threaded outer end. Tightening of the nut 14 positions the terminal with its outer end exposed for connection to the power line. The other or right hand end 1*b* of the coil is welded to this terminal conductor 11 and the terminal may be surrounded by a short ceramic insulating tube 15.

To make this new heater commercially acceptable the previously mentioned second rigid non-conductive refractory tube 16 encirlces the conductor 6 inside of the first tube 2. The ends of this second tube is positioned in holes in the two end caps 3 and 3*a* and the flange 4. The second tube for practical reasons must also be made of a ceramic material. Of the ceramic tubes commercially available there are some recommended more for their electrical insulation properties at elevated temperatures than they are for strength and this type is preferred for the tube 16. It is also subject to cracking under thermal stress and particularly when hot spots are present. The first tube 2 is preferably made of the ceramic material used for high strength.

However, as previously indicated, there is very little chance that both the tube 2 and 16 will crack at the same place so as to risk a short-circuit between the coil 1 and the conductor 6. Cracked or opening in radial registration between the two tubes is so improbable that both tubes can crack in a number of places without a short-circuit resulting. Such cracking does not necessarily result in actual breakage of either tube so as to affect the beam strength of the assembly. Such breakage is made improbable in any event unless by chance both tubes weaken at the same place.

Commercially available ceramic tube is not produced free from all curvature. Therefore, the inside diameter of the tube 2 is made larger than the outside diameter of the tube 16 and the latter is chosen with an inside diameter that is larger than the diameter of the conductor 6.

The circumferential space between the tubes 2 and 16 is preferably filled with a soft fibrous ceramic refractory 17 which prevents chattering between the tubes 2 and 16 in the event of vibration induced by the air blast. Such material also is used between the spacer 5 and the electrically insulating tube 16 of greater insulating properties, the latter extending from the washer 8 and the outside of the flange 4, via suitable openings in the parts 3 and 4, backwardly so that its inner end is axially in the hole 18 of the counterbore which receives that end of the tube 2. Between the inner end of the tube 16 and the washer 7 fixed to the elastically tensioned conductor 6, soft fibrous ceramic material 18*a* is packed. Such ceramic fibrous material is also indicated at 19 between the ceramic end cap 3 and mounting flange 4 and in the form of a wall. This material can be any adequately refractory fibrous material providing at least some elastic deformability.

In this illustrated example the electric resistance wire, the conductor 6 and the terminal 11 are preferably all made of electric resistance heating wire such as the Fe-Cr-Al alloys sold under the trademark "Kanthal." Other appropriate electric resistance material can be used.

Incidentally, a porcupine coil is usually described as comprising a substantially helical series of substantially flat convolutions having straight legs and hooked ends.

What is claimed is:

1. An electric resistance heater having an exposed resistance coil adapted to be positioned transversely to a high velocity blast of air for convection heating of the air to metal heating-treating temperatures and comprising an elongated coil of resistance wire, a first rigid non-conductive refractory tube extending through the coil so as to support the coil from sagging when horizontally positioned, terminals positioned at only one end of the tube for the opposite ends of the coil, and a conductor extending through the tube, one of the coil's ends connecting directly with one of the terminals at said one end of the tube and the other of the coil's ends connecting at the other end of the tube with the conductor and the conductor connecting with another of the terminals at said one end of the tube, the first tube containing a second rigid non- conductive refractory tube encircling the conductor, both tubes being subject to cracking when thermally stressed and a short-circuit between the coil and conductor being possible only if both tubes crack at the same place, said coil being a porcupine coil comprising a substantially helical series of substantially flat convolutions having straight legs and looped ends, the legs contacting said first tube tangetially so as to form hot spots therein when the coil is heated, said tubes being made of ceramic materials and said heater having means for structurally uniting said tubes and conductor via their respective end portions.

2. The element of claim 1 in which a radial space is formed between the tubes and shock-absorbing refractory material fills said space between the tubes.

3. The element of claim 1 in which said conductor is elastically tensioned so as to be held straight inside of the second tube and the second tube has an inside diameter greater than the conductor's diameter, said conductor having means for rigidly mounting one of its ends and spring means for slidably holding the other end of the conductor so as to tension the conductor.

4. The element of claim 1 in which the first tube's ceramic material is more resistance to said cracking than is the second tube's material and the latter is a better electrical insulator than the first tube's material.

* * * * *